US005280841A

United States Patent [19]

Van Deursen

[11] Patent Number: 5,280,841

[45] Date of Patent: Jan. 25, 1994

[54] PORTABLE SUPPORT ASSEMBLY

[76] Inventor: Aad Van Deursen, 1111 Tenth Ave., Rochelle, Ill. 61068

[21] Appl. No.: 902,930

[22] Filed: Jun. 23, 1992

[51] Int. Cl.[5] ..... A47F 7/00

[52] U.S. Cl. ..... 211/197; 211/1.3; 211/189

[58] Field of Search ..... 211/197, 189, 1.3, 196

[56] References Cited

U.S. PATENT DOCUMENTS

| | | | |
|---|---|---|---|
| 2,443,772 | 6/1948 | Mappin | 211/197 X |
| 2,638,231 | 5/1953 | Tardie et al. . | |
| 2,661,849 | 12/1953 | Spalding | 211/197 X |
| 2,747,749 | 5/1956 | Shore et al. | 211/197 |
| 2,794,556 | 6/1957 | Lego . | |
| 2,804,215 | 8/1957 | Pierie . | |
| 3,069,021 | 12/1962 | Gray . | |
| 3,139,190 | 6/1964 | Shore | 211/197 |
| 3,163,297 | 12/1964 | Raynor . | |
| 3,252,469 | 5/1966 | Peake . | |
| 4,101,037 | 7/1978 | Allesch et al. . | |
| 4,206,847 | 6/1980 | Brink | 211/197 X |
| 4,550,840 | 11/1985 | Van Deursen . | |
| 4,732,285 | 3/1988 | Wüster . | |

OTHER PUBLICATIONS

A & B Leisure, Inc., The Atlantic Bench Co., "Aluminum/Resin Clothes Dryers with Multi-Position Locking Mechanism" Product Information Blome pp. 1-8.

*Primary Examiner*—Alvin C. Chin-Shue
*Assistant Examiner*—Sarah A. Lechok
*Attorney, Agent, or Firm*—Wallenstein, Wagner & Hattis, Ltd.

[57] ABSTRACT

A portable support assembly adapted for mounting on a pole, such as for permitting air drying of clothes, towels, or the like, is disclosed. The assembly comprises a first collar having a first aperture adapted for receiving the pole. A first set of arms extend from the first collar. Each arm of the first set of arms terminates at a distal end. A second collar having a second aperture adapted for receiving the pole is also provided. A second set of arms extend from the second collar. Each arm of the second set of arms terminates at a distal end, wherein each arm of the first set of arms corresponds to a respective arm of the second set of arms. A third set of arms is further provided. Each arm of the third set of arms has an end and is pivotally joined to the distal end of respective ones of the second set of arms. Each of the third set of arms are removably joined to the distal end of respective ones of the first set of arms.

18 Claims, 3 Drawing Sheets

PORTABLE SUPPORT ASSEMBLY

TECHNICAL FIELD

The invention relates to a portable support assembly, and, more particularly, to a portable support assembly for supporting fabric, such as clothes, towels, or the like, to permit the drying thereof.

BACKGROUND PRIOR ART

Portable clothes drying devices are known in the art. Van Deursen, U.S. Pat. No. 4,550,840, discloses a clothes drying device comprising a spider assembly removably supported by a tubular mast. The spider assembly includes a number of outwardly extending arms. When removed from the mast, the spider assembly is able to collapse. However, the spider assembly, even when collapsed, remains relatively large and unwieldy because of the relatively long arms.

The present invention is provided to solve these and other problems.

SUMMARY OF THE INVENTION

It is an object of the invention to provide a portable support assembly adapted for mounting on a pole, and which can be collapsed into a relatively small bundle. It is comprehended that the support assembly can be used for supporting clothes, towels or the like, in the air to permit the air drying thereof.

In accordance with the invention, the assembly comprises a first collar having a first aperture adapted for receiving the pole. A first set of arms extend radially outwardly from the first collar. Each arm of the first set of arms terminates at a distal end.

A second collar is also provided having a second aperture also adapted for receiving the pole. A second set of arms extend radially from the second collar. Each arm of the second set of arms terminates at a distal end. Each arm of the first set of arms corresponds to a respective arm of the second set of arms.

A third set of arms is further provided. Each arm of the third set of arms has an end and is pivotally joined to the distal end of a respective arm of the second set of arms. Means are provided for removably joining each arm of the third set of arms to the distal end of the respective arms of the first set of arms. The removably joining means comprises a plurality of plugs. One of the plugs extend outwardly from a respective arm of the first or third sets of arms. A plurality of hollows are provided in the end of each of the arms of the other of the first or third sets of arms. Each of the hollows are adapted to snugly receive a respective one of the plugs.

Thus, the support assembly can be readily collapsed into a smaller bundle, because the second set of arms can be separated from the first and third set of arms.

It is comprehended that each arm of the third set of arms are parallel to respective arms of the second set of arms. In particular, it is comprehended that each arm of the third set of arms are co-linear to respective arms of the second set of arms.

It is further comprehended that a cord, or cords, extend between adjacent arms of the third set of arms. In particular, each arm of the third set of arms includes a plurality of spaced openings extending therethrough. The openings are adapted for receiving the cord, or cords.

It is still further comprehended that the first and second collars include means for securing themselves to the pole. In particular, the securing means comprises respective first and second bores radially extending through respective ones of the first and second collars, and respective first and second spring-biased pins disposed in the first and second threaded bores and biased into engagement with the pole.

Other features and advantages of the invention will be apparent from the following specification taken in conjunction with the following drawing.

DETAILED DESCRIPTION

Figure 1:
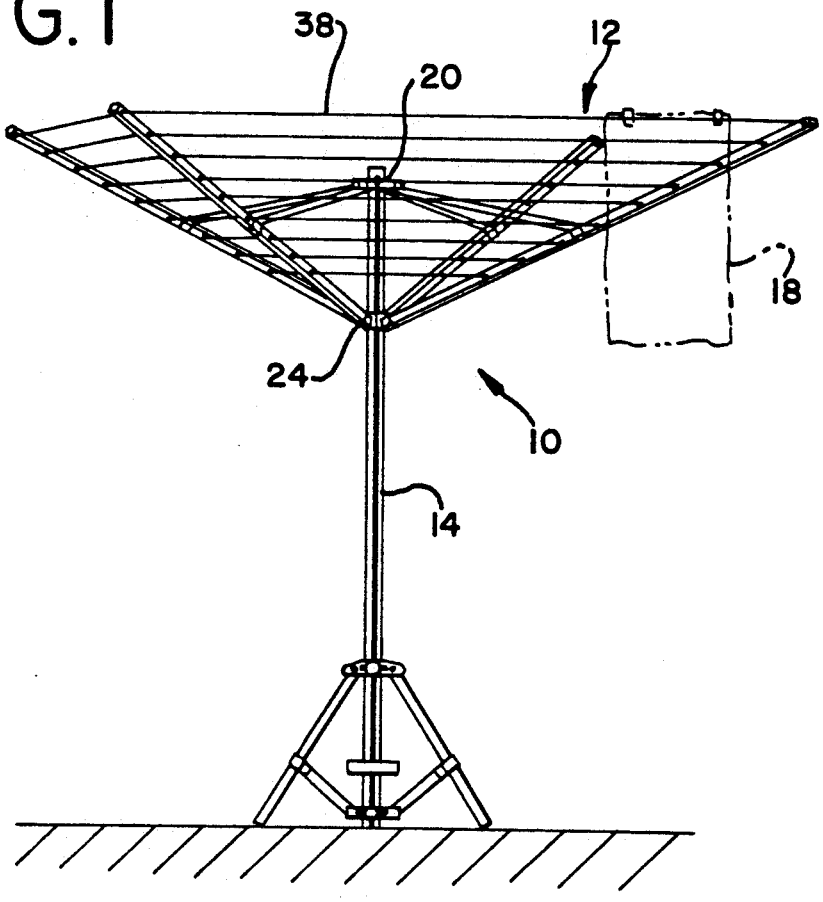
FIG. 1 is an elevational view of a clothes dryer utilizing the portable support assembly in accordance with the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A clothes dryer, generally designated 10, utilizing a portable support assembly 12 in accordance with the invention is illustrated in FIG. 1. A similar clothes dryer, absent the invention disclosed herein, is disclosed in greater detail in Van Deursen, U.S. Pat. No. 4,550,840, the specification of which is expressly incorporated herein by reference.

The support assembly 12 is adapted for mounting on a pole, or mast, 14, and can be advantageously collapsed into a relatively small bundle. The support assembly 12 can be used for supporting materials in the air for drying, such as a towel 18, clothes or the like.

Figure 2:
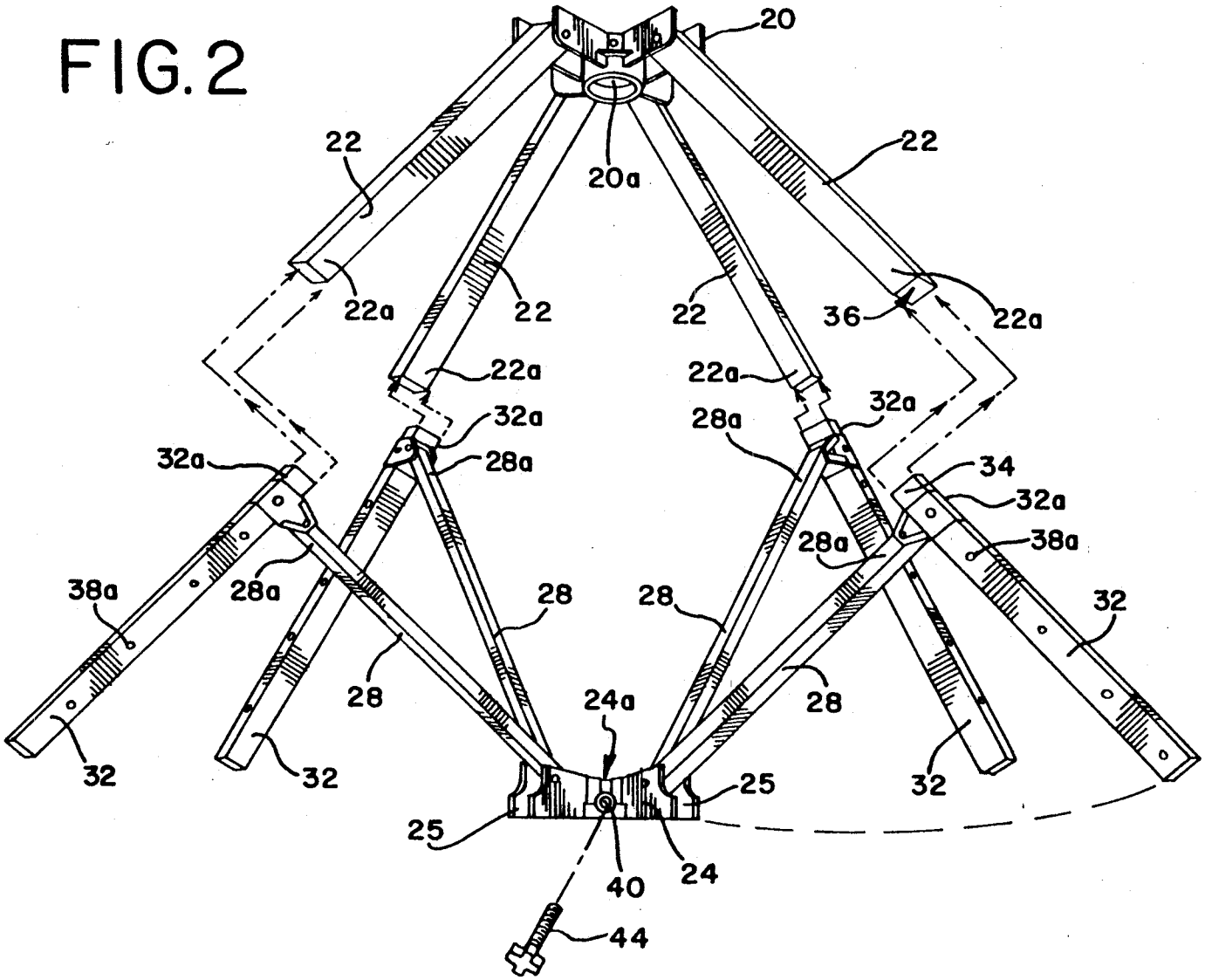
FIG. 2 is a perspective view of the support assembly of FIG. 1.

The support assembly 12 is shown in greater detail in FIG. 2.

The support assembly 12 comprises a first collar 20 having a first aperture **20*a* adapted for securely receiving the pole 14. A first set of arms 22 extend generally radially outwardly from the first collar 20. Each arm of the first set of arms 22 terminates at a distal end 22*a***.

A second collar 24 is also provided having a second aperture **24*a*. The second collar 24 is also adapted for securely receiving the pole 14. A second set of arms 28 extend generally radially from the second collar 24. Each arm of the second set of arms 28 terminates at a distal end 28*a*. Each arm of the first set of arms 22 corresponds to a respective arm of the second set of arms 28**.

A third set of arms 32 is further provided. Each arm of the third set of arms 32 has an end **32*a* and is pivotally joined to the distal end 28*a* of respective arms of the second set of arms 28. When assembled, each arm of the third set of arms is colinear to respective arms of the first set of arms. The second collar 24 includes four recesses 25 which receive respective arms of the third set of arms 32**, when collapsed.

The arms of the first, second and third sets of arms are made of light-weight, high-strength aluminum tubes. The arms of the third set of arms 32 are removably joined to the distal end 22*a* of respective arms of the first set of arms 22 by a plurality of plugs 34. As the arms are formed of tubular aluminum, they include hollows 36. One of the plugs 34 is secured within the respective hollow of respective arms of each arm of the third set of arms 32. Each of the plugs 34 has an extension which extends outwardly from the respective hollow, and each of the plugs 34 is adapted to be snugly received by respective hollows in each of the first set of arms 22. Thus, the support assembly 12 can be easily disassembled so that it can be collapsed into a much smaller bundle than prior devices, because the first set of arms 22 can be separated from the second and third set of arms 28,32.

As illustrated in FIG. 1, a plurality of cords 38 extend between adjacent ones of the third set of arms 32. In particular, each of the third set of arms 32 includes a plurality of spaced openings 38 (FIG. 2) extending therethrough. The openings 38 are adapted for receiving the cord, or cords, 38.

Figure 4:
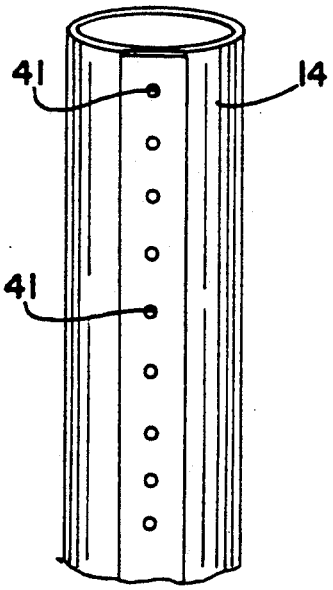
FIG. 4 is an elevational view of a part of the pole for supporting the portable supported assembly.
Figure 5:
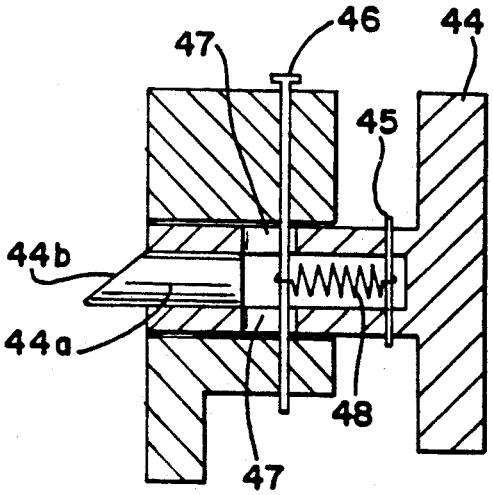
FIG. 5 a sectional view of a spring biased pin disposed within a collar of the support assembly.

The first and second collars 20,24, which are structurally the same, are illustrated in FIG. 2. As discussed above, the first and second collars 20,24, include means for securing themselves to the pole 14. In particular, the securing means comprises a bore 40 radially extending through a respective one of the first and second collars, 20,24 to the respective apertures 20*a*,24*a*. Respective spring-biased pins 44, as illustrated in greater detail in FIG. 5, are disposed in the respective threaded bores 40 and are biased into engagement with one of a series of holes 41 (FIG. 4) disposed along the pole 14.

In particular, each of the spring biased pins 44 includes a metallic extension 44*a* having a beveled nose 44*b*. The pin 44 further includes a securing rod 45 extending diametrically through the pin 44. The pin 44 is retained within the bore 40 by an elongated pin 46. The pin 44 is configured with upper and lower slots 47 to permit longitudinal movement of the pin 44 relative to the elongated pin 46 along the upper and lower slots 47. A spring 48 couples the elongated pin 46 to the securing rod 45, biasing the pin 44 leftwardly. The spring-biased pin 44 can be withdrawn rightwardly the length of the slots 47, thereby releasing the beveled nose 44*b* from the respective hole 41 in the pole 14, thus permitting the collars 20,24 to slide relative to the pole 14. The beveled nose 44*b* permits the pin 44 to more easily release from the pole 14 when collapsing the devise.

Figure 3:
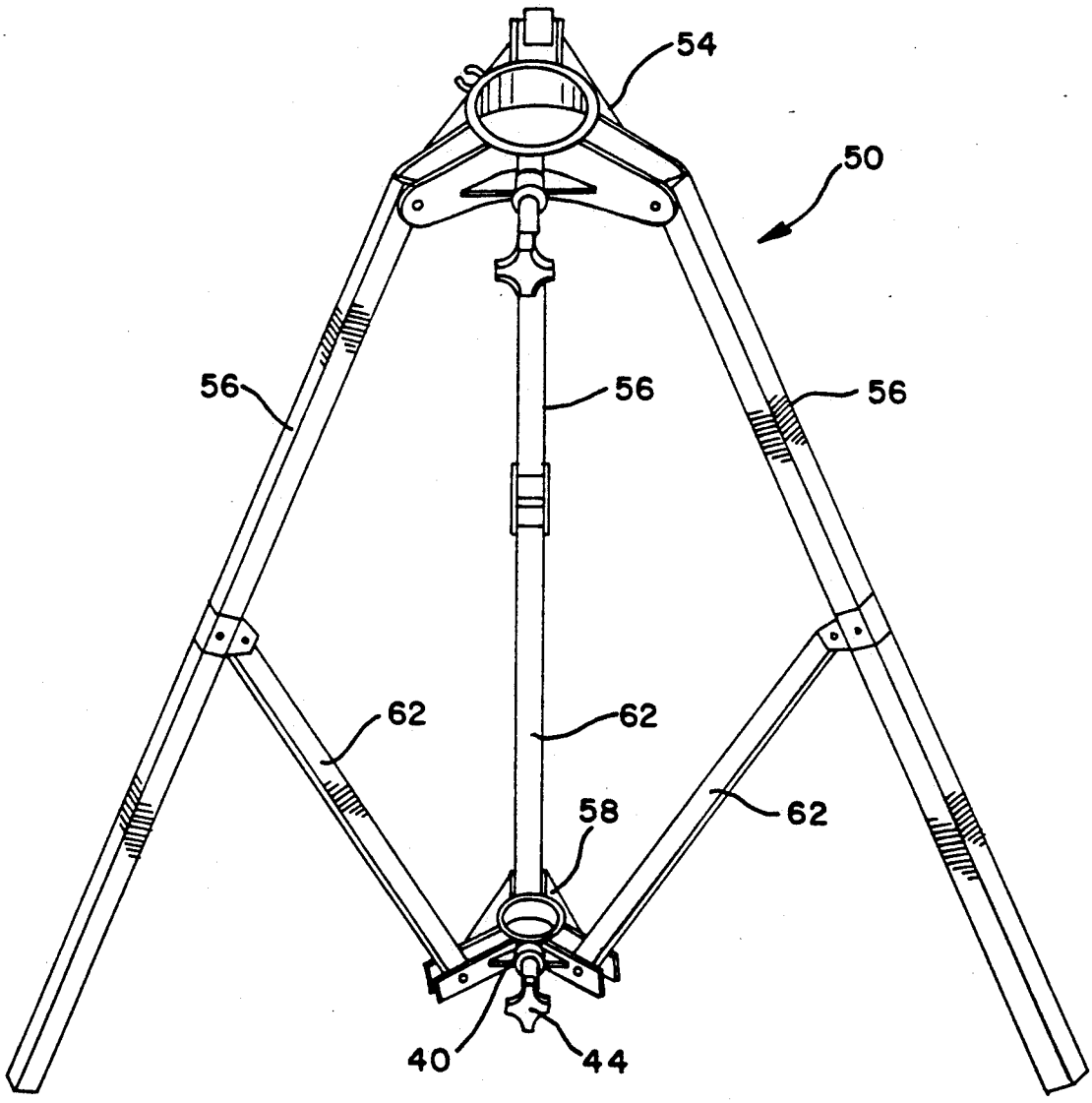
FIG. 3 is a perspective view of a stand for supporting the clothes dryer of FIG. 1.

A stand 50 for supporting the mast 14 is illustrated in FIG. 3. The stand 50 has a third collar 54 and three depending legs 56. A fourth collar 58 is pivotally joined to the depending legs 56 via three connecting legs 62. The third and fourth collars 54, 58, have a threaded bore 40' radially extending through respective ones of the third and fourth collars, 54', 58'. Respective threaded bolts 44' are disposed in the threaded bore 40' and are rotatable into engagement with the pole 14 to secure the pole 14 to the stand 50. Similar to the second collar 24, the fourth collar 58 includes three recesses 25 which receive the respective ends of the three depending legs 56 when the stand 50 is collapsed.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A portable support assembly adapted for mounting on a pole, said assembly comprising:

a first collar having a first aperture adapted for receiving said pole;

a first set of arms extending away from said first collar, each arm of said first set of arms terminating at a distal end;

a second collar having a second aperture adapted for receiving said pole;

a second set of arms extending away from said second collar, each arm of said second set of arms terminating at a distal end, wherein each arm of said first set of arms corresponds to a respective arm of said second set of arms;

a third set of arms, each arm of said third set of arms having an end;

means for pivotally joining each arm of said third set of arms to the distal end of respective ones of said second set of arms; and means for removably joining each arm of said third set of arms to the distal end of respective ones of said first set of arms.

2. The assembly of claim 1 wherein each arm of said third set of arms is parallel to respective ones of said first set of arms.

3. The assembly of claim 1 wherein each arm of said third set of arms is co-linear to respective ones of said first set of arms.

4. The assembly of claim 1 including a cord extending between adjacent arms of said third set of arms.

5. The assembly of claim 4 wherein each of said third set of arms includes a plurality of spaced openings extending therethrough, said openings adapted for receiving said cord.

6. The assembly of claim 1 including means for securing said first and second collars to said pole.

7. The assembly of claim 6 wherein said securing means comprises respective first and second bores radially extending through respective ones of said first and second collars, and respective first and second bolts disposed in said first and second bores and insertable into engagement with said pole.

8. The assembly of claim 1 wherein each of said first, second and third sets of arms comprise four equi-angularly spaced, arms.

9. The assembly of claim wherein said means for removably joining each of said third set of arms to the distal end of respective ones of said first set of arms comprises:

a plurality of plugs, one of said plugs extending outwardly from a respective one of said first or third sets of arms; and a plurality of hollows, one of said hollows in the end of each of the other of said first or third sets of arms, wherein each of said hollows are adapted to snugly receive a respective one of said plugs.

10. A portable support assembly adapted for mounting on a pole, said support assembly comprising:

a first collar having a first aperture adapted for receiving said pole, said first collar having means for securing said pole within said first aperture;

a first set of arms pivotally extending from said first collar, each arm of said first set of arms terminating at a distal end;

a second collar having a second aperture adapted for receiving said pole, said second collar having means for securing said pole within said second aperture;

a second set of arms pivotally extending from said second collar, each arm of said second set of arms terminating at a distal end, wherein each of said first set of arms corresponds to a respective one of said second set of arms;

a third set of arms, each arm of said third set of arms having a proximal end;

means for pivotally joining the proximal end of each of said third set of arms to the distal end of respective ones of said second set of arms;

means for removably joining each of said third set of arms to the distal end of respective ones of said first set of arms; and a cord extending between adjacent ones of said third set of arms.

11. A portable clothes drying device comprising:

a collapsible stand having a plurality of legs extending from a collar and adapted for supporting said collar in spaced relationship from a surface;

a pole disposed within said collar and extending upwardly therefrom; and a support assembly, said support assembly comprising a first collar having a first aperture adapted for receiving said pole, said first collar having means for securing said pole within said first aperture; a first set of arms pivotally extending from said first collar, each arm of said first set of arms terminating at a distal end; a second collar having a second aperture adapted for receiving said pole, said second collar having means for securing said pole within said second aperture; a second set of arms pivotally extending from said second collar, each arm of said second set of arms terminating at a distal end, wherein each arm of said first set of arms corresponds to a respective one of said second set of arms; a third set of arms, each arm of said third set of arms having a proximal end; means for pivotally joining the proximal end of each arm of said third set of arms to the distal end of respective ones of said second set of arms; and means for removably joining each arm of said third set of arms to the distal end of respective ones of said first set of arms.

12. The assembly of claim 11 wherein each arm of said third set of arms is parallel to respective ones of said first set of arms.

13. The assembly of claim 11 wherein each arm of said third set of arms are co-linear to respective ones of said first set of arms.

14. The assembly of claim 11 wherein each arm of said third set of arms includes a plurality of spaced openings extending therethrough, said openings adapted for receiving a cord.

15. The assembly of claim 11 including means for securing said first and second collars to said pole.

16. The assembly of claim 15 wherein said securing means comprises respective first and second threaded bores radially extending through respective ones of said first and second collars, and respective first and second threaded bolts disposed in said first and second threaded bores and rotatable into engagement with said pole.

17. The assembly of claim 11 wherein each of said first, second and third sets of arms comprise four equiangularly spaced, arms.

18. The assembly of claim wherein said means for removably joining each arm of said third set of arms to the distal end of respective ones of said first set of arms comprises:

a plurality of plugs, one of said plugs extending outwardly from each respective arm of said first or third sets of arms; and a plurality of hollows, one of said hollows in the end of each of the other of said first or third sets of arms, wherein each of said hollows is adapted to snugly receive a respective one of said plugs.

* * * * *